US010458298B2

(12) United States Patent
Peters

(10) Patent No.: US 10,458,298 B2
(45) Date of Patent: Oct. 29, 2019

(54) EXHAUST GAS SYSTEM FOR AN INTERNAL COMBUSTION ENGINE

(71) Applicant: AUDI AG, Ingolstadt (DE)

(72) Inventor: Axel Peters, Freising (DE)

(73) Assignee: AUDI AG, Ingolstadt (DE)

( * ) Notice: Subject to any disclaimer, the term of this patent is extended or adjusted under 35 U.S.C. 154(b) by 181 days.

(21) Appl. No.: 15/329,475

(22) PCT Filed: Mar. 20, 2015

(86) PCT No.: PCT/EP2015/000618

§ 371 (c)(1),
(2) Date: Jan. 26, 2017

(87) PCT Pub. No.: WO2016/015791

PCT Pub. Date: Feb. 4, 2016

(65) Prior Publication Data

US 2017/0211439 A1 Jul. 27, 2017

(30) Foreign Application Priority Data

Aug. 1, 2014 (DE) ..... 10 2014 011 618

(51) Int. Cl.
*F01N 1/16* (2006.01)
*F01N 1/02* (2006.01)
(Continued)

(52) U.S. Cl.
CPC ..... *F01N 1/161* (2013.01); *F01N 1/02* (2013.01); *F01N 1/023* (2013.01); *F01N 13/02* (2013.01);
(Continued)

(58) Field of Classification Search
CPC . F01N 1/02; F01N 1/023; F01N 1/161; F01N 13/02; F01N 13/04; F01N 2470/14; F01N 2470/20; F01N 2490/00
(Continued)

(56) References Cited

U.S. PATENT DOCUMENTS

2002/0033302 A1 3/2002 Kaneko et al.
2003/0121720 A1 7/2003 Chang
(Continued)

FOREIGN PATENT DOCUMENTS

DE 41 06 918 A1 9/1992
DE 10 2004 046 184 A1 5/2005
(Continued)

OTHER PUBLICATIONS

International Search Report issued by the European Patent Office in International Application PCT/EP2015/000618.

*Primary Examiner* — Audrey K Bradley
*Assistant Examiner* — Dapinder Singh
(74) *Attorney, Agent, or Firm* — Henry M. Feiereisen LLC

(57) ABSTRACT

An exhaust gas system for an internal combustion engine includes a first exhaust gas line leading into a first muffler; a second exhaust gas line arranged fluidly parallel to the first exhaust gas line and leading into a second muffler, wherein the first and second exhaust gas lines are respectively connected upstream of the first and second muffler at a branch to a common exhaust gas feed line; a control valve arranged in the first exhaust gas line upstream of the first muffler; and a damping device fluidly arranged between the branch and the control valve and adapted for damping exhaust gas resonance vibrations.

8 Claims, 2 Drawing Sheets

(51) Int. Cl.
*F01N 13/02* (2010.01)
*F01N 13/04* (2010.01)

(52) U.S. Cl.
CPC ..... *F01N 13/04* (2013.01); *F01N 2470/14* (2013.01); *F01N 2470/20* (2013.01); *F01N 2490/00* (2013.01)

(58) Field of Classification Search
USPC ..... 60/312, 322, 324
See application file for complete search history.

(56) References Cited

U.S. PATENT DOCUMENTS

2004/0006970 A1* 1/2004 Worner ..... F01N 1/166 60/272
2005/0067219 A1 3/2005 Albertson et al.
2008/0302597 A1* 12/2008 Kruger ..... F01N 13/02 181/238
2010/0043398 A1 2/2010 Abram et al.
2010/0230204 A1* 9/2010 Inoue ..... F01N 1/04 181/255
2010/0300799 A1* 12/2010 Matsueda ..... F01N 1/006 181/228
2012/0318232 A1* 12/2012 Miyasaka ..... B60T 13/52 123/198 R
2013/0118461 A1* 5/2013 Mitchell ..... F02D 21/08 123/681
2014/0157773 A1* 6/2014 Matthews ..... F02B 37/00 60/605.3
2014/0166393 A1 6/2014 Butler et al.
2014/0166394 A1* 6/2014 Winkel ..... F01N 13/107 181/228
2014/0174074 A1* 6/2014 Hilditch ..... F02B 37/12 60/602
2014/0331668 A1* 11/2014 Bidner ..... F02M 26/36 60/605.2

FOREIGN PATENT DOCUMENTS

DE 10 2012 112 433 A1 6/2014
EP 0681 644 B1 11/1995
EP 2 000 643 A1 12/2008
EP 2 049 775 B1 4/2009
WO WO 2014/034731 A1 3/2014

* cited by examiner

EXHAUST GAS SYSTEM FOR AN INTERNAL COMBUSTION ENGINE

CROSS-REFERENCES TO RELATED APPLICATIONS

This application is the U.S. National Stage of International Application No. PCT/EP2015/000618, filed Mar. 20, 2015, which designated the United States and has been published as International Publication No. WO 2016/015791 and which claims the priority of German Patent Application, Serial No. 10 2014 011 618.2, filed Aug. 1, 2014, pursuant to 35 U.S.C. 119(a)-(d).

BACKGROUND OF THE INVENTION

The invention relates to an exhaust gas system for an internal combustion engine with a first exhaust gas line leading into a first muffler and a second exhaust gas line which is fluidly arranged parallel to the first exhaust gas line and leads into a second muffler, wherein the exhaust gas lines are connected at a branch upstream of the respective muffler to a common exhaust gas feed line.

The exhaust gas system is for example assigned to a motor vehicle, which has the internal combustion engine. By means of the internal combustion engine a torque can be provided, which is directed toward a drive, in particular a forward drive, of the motor vehicle. The exhaust gas system serves for discharging exhaust gas generated by the internal combustion engine during its operation. The exhaust gas is intended to first flow through the common exhaust gas feed line. For this purpose the exhaust gas feed line is for example connected to an exhaust manifold of the internal combustion engine.

At the branch the exhaust gas is conducted from the exhaust gas feed line into the first exhaust gas line as well as into the second exhaust gas line. At the branch the first exhaust gas line and the second exhaust gas line thus branch off from the common exhaust gas feed line. In particular the exhaust gas feed line ends at the branch while the first exhaust gas line and the second exhaust gas line extend fro the branch. The first exhaust gas line and the second exhaust gas line are insofar arranged downstream of the exhaust gas feed line.

The first exhaust gas line leads into the first muffler while the second exhaust gas line leads into the second muffler. This means that the first muffler and the second muffler each are respectively located downstream of the branch in the respective exhaust gas line, i.e., the first exhaust gas line or the second exhaust gas line. The muffler has the purpose to dampen, i.e., reduce the loudness of the sound generated by the internal combustion engine or the exhaust gas.

The exhaust gas system for example has at least two end tubes, wherein one of the end tubes is fluidly connected with the first exhaust gas line and a second end tube is fluidly connected with the second exhaust gas line. In particular the respective end tube is situated downstream of the first muffler or the second muffler.

From the state of the art for example the patent document DE 10 2004 046 184 A1 is known. This document relates to a system for damping exhaust noise generated by a motor with a first group of activated cylinders and a second group of deactivatable cylinders. The system includes a first exhaust manifold, which is connected with a second exhaust manifold, which is connected with a group of activated cylinders, and a second exhaust manifold, which is connected with the second group of deactivatable cylinders. The second exhaust manifold is connected with the first exhaust manifold so that the second exhaust manifold acts as a resonator in order to dampen sound originating from the first group of activated cylinders when the second group of cylinders is deactivated.

SUMMARY OF THE INVENTION

It is an object of the invention to propose an exhaust gas system for an internal combustion engine, which has advantages compared to the state of the art and in particular enables an adjustable sound behavior while at the same time requiring a small amount of space or mounting space.

This is achieved according to the invention with an exhaust gas system with the features of the independent claim. Hereby it is provided that in the first exhaust gas line a control valve is arranged upstream of the first muffler, wherein fluidly between the branch and the control valve a damping device for damping exhaust gas vibrations is provided. The control valve serves for adjusting a defined flow cross section in the first exhaust gas line. The control valve is fluidly arranged between the branch and the first muffler so that the flow connection between the branch and the first muffler or its flow cross section can be adjusted by means of the control valve. In particular the flow connection can be interrupted, partially released or fully released for which purpose the control valve is present in a respective position.

The mufflers are for example constructed as end muffler with an end tube adjoining the end muffler downstream of the respective exhaust gas line. Overall for example the following construction of the exhaust gas system is provided: the exhaust gas generated by the internal combustion engine is first supplied to the exhaust gas feed line, for which purpose the latter is in particular connected to an exhaust gas manifold or a Y-branch pipe of the internal combustion engine. The exhaust gas feed line extends up to the branch, where it transitions into the first exhaust gas line and the second exhaust gas line. This means that the exhaust gas feed line ends at the branch, where it enters into the first exhaust gas line and also into the second exhaust gas line. Both exhaust gas lines are thus connected to the exhaust gas feed line parallel to each other.

The exhaust gas can flow through the exhaust gas lines in the direction of the respective muffler. The mufflers are insofar connected to the respective exhaust gas line downstream of the branch. The exhaust gas flows to the corresponding muffler through the respective exhaust gas line and from the muffler into the corresponding end tube. Consequently the first exhaust gas line leads into the first muffler and the first muffler is connected to a first end tube so that exhaust gas can flow from the first exhaust gas line into the first muffler and from the first muffler into the second end tube when the control valve is at least partially, in particular fully, opened.

The second exhaust gas line on the other hand leads into the second muffler to which the second end tube is connected so that the exhaust gas can flow from the second exhaust gas line to the second muffler and from the second muffler into the second end tube. Particularly preferably the flow connection between the branch and/or the second muffler and/or the second end tube is permanently released and insofar is constructed without a control valve. The exhaust gas generated by the internal combustion engine thus permanently flows through the second exhaust gas line, the second muffler and the second end tube.

Downstream of the first end tube and/or the second end tube the exhaust gas reaches an external environment of the exhaust gas system or the motor vehicle. By means of the control valve it can now selectively be adjusted whether the exhaust gas only flows through the second exhaust gas line or through both exhaust gas lines and is discharged into the external environment via the corresponding end tube.

The control valve can generally be arranged downstream of the first muffler. This has the advantage that pressure impulses of the exhaust gas are damped in the first muffler so that unwanted resonance phenomena can be avoided. However this arrangement is space consuming so that according to the invention the control valve is arranged upstream of the first muffler. Such an arrangement however may cause resonance vibrations in the first exhaust gas line.

For this reason the damping device for damping exhaust gas resonance vibrations is assigned to the control valve. This damping device is fluidly arranged between the branch and the control valve i.e., upstream of the control valve, for example in the first exhaust gas line. At least however it is assigned to the first exhaust gas line. The damping device can generally be configured arbitrarily. Individual exemplary embodiments are explained below.

In a preferred embodiment of the invention it is provided that the damping device has a flow connection between the first exhaust gas line and the second exhaust gas line. Through the flow connection exhaust gas can flow from the first exhaust gas line into the second exhaust gas line and vice versa. Thus pressure impulses, which may occur in the first exhaust gas line in particular when the control valve is partially or completely closed, can be reduced in the direction of the second exhaust gas line.

The flow connection has for example a connection line, which on one side leads into the first exhaust gas line and on the other side into the second exhaust gas line. The site of entry of the connection line into the first exhaust gas line is located upstream of the control valve, preferably directly upstream of the control valve. With respect to the flow path from a beginning of the first exhaust gas line or the branch up to the control valve this for example means that the site of entry of the connection line into the first exhaust gas line starting from the beginning of the first exhaust gas line or the branch is at least 50%, at least 60%, at least 70%, at least 75%, at least 80%, at least 90% or at least 95%, In particular the flow path is observed between the branch and the control valve.

A further embodiment of the invention provides that in the flow connection a throttle or a cross section adjustment element is provided. The throttle causes a permanent reduction of the cross section in the flow connection or the connection line. This means that a minimal flow cross section of the throttle is smaller than a smallest flow cross section of the first exhaust gas line and/or the second exhaust gas line. As an alternative the cross section adjustment element can be present in the flow connection. By means of the cross section adjustment element the flow cross section of the flow connection or the connection line can be adjusted. The adjustment can hereby be provided in any desired manner.

In a further embodiment of the invention it is provided that the cross section adjustment element is configured as a spring loaded check valve. The check valve is hereby in particular configured so that it only permits crosstalk from the first exhaust gas line into the second exhaust gas line so that pressure impulses occurring in the first exhaust gas line can be reduced in the direction of the second exhaust gas line. In the other hand the check valve prevents crosstalk from the second exhaust gas line in the direction of the first exhaust gas line.

The check valve is impinged with a spring force by means of a spring element. The spring force is selected so that the check valve remains closed when a medium pressure level prevails in the first exhaust gas line and only when this medium pressure level is exceeded, for example as a result of pressure impulses, the check valve is opened so that the pressure impulses are reduced and thus the exhaust gas resonance vibrations can be damped.

A preferred embodiment of the invention provides that the damping device has a sound absorber. The sound absorber includes for example a hollow body through which or over which exhaust gas flows. The hollow body has preferably inner dimensions that are greater than the cross sectional dimensions of the first exhaust gas line so that insofar a sufficiently large damping volume is available. The sound absorber can for example be configured as an expansion chamber or as an absorption chamber. The term expansion chamber means a chamber or hollow space through which the exhaust gas flows and in which for example a sudden increase and subsequent decrease of the flow cross section is present. The cross sectional changes result in an effective damping of the exhaust gas resonance vibrations.

A particularly preferred embodiment of the invention provides that the sound absorber is configured as a resonance absorber. The resonance absorber has for example a mass, which is supported or suspended for displacement. The energy contained in the exhaust gas resonance vibrations can be converted into kinetic energy by means of this mass. The maximal absorption hereby occurs in the range of the natural frequency of the mass at which usually also the strongest vibrations of the mass can occur.

In a further embodiment of the invention it can be provided that the damping device has a flow rectifier. The flow rectifier serves for the targeted orientation of the flow through the flow rectifier or the orientation of vibrations in the flow. The flow rectifier can insofar also be referred to as a sound-velocity-rectifier.

An embodiment of the invention provides that the flow rectifier has at least one nozzle, which leads into an open-jet volume. The orientation or rectification of the flow by the flow rectifier is achieved by means of the nozzle, which in flow direction is preferably configured as a convergent nozzle. The nozzle insofar first causes a reduction of the flow cross section in flow direction, which causes the vibrations to be damped or to be oriented in flow direction. The nozzle thus damps vibrations or turbulences, which are present in a direction perpendicular to the flow direction or main flow direction.

The nozzle leads into an open-jet volume, which means that fluidly directly after the nozzle a sudden increase of the cross section is provided. It is for example provided that the flow rectifier has a housing in which at least one nozzle, particularly preferably multiple nozzles arranged one after the other in flow direction, are arranged, wherein directly downstream of each nozzle an inner cross section of the housing suddenly increases. Thus the same flow cross section, i.e., the inner cross section of the housing, is present fluidly upstream and fluidly downstream of the nozzle.

According to a further embodiment of the invention, it can also be provided that the second exhaust gas line is configured without a control valve. Such a configuration was mentioned above. Thus no control valve is present in the second exhaust gas line so that the flow connection between the branch and the second muffler is free of interruptions.

Particular preferably the entire flow connection through the second exhaust gas line between the branch and the external environment is free of interruptions or respectively configured without control valve.

Finally it can be provided that an exhaust a turbocharger is provided upstream of the branch. The exhaust gas turbocharger or a turbine of the exhaust gas turbocharger arranged upstream of the branch serves for converting flow energy of the exhaust gas into kinetic energy, which is subsequently used for compressing air, in particular fresh air. The air is subsequently, i.e., at a higher pressure level, supplied to the internal combustion engine. The exhaust gas turbocharger insofar serves for increasing the efficiency and/or power of the internal combustion engine.

It can be provided that the branch is present in a muffler or is formed by a muffler. The muffler is hereby for example configured as a pre-muffler, particularly preferably as a middle muffler. In such a configuration it is provided that the common exhaust gas feed line leads into the muffler and downstream the two exhaust gas lines lead out of the muffler. The exhaust gas thus flows through the exhaust gas feed line into the muffler and is conducted out of the muffler again through the two exhaust gas lines.

The invention is of course also directed toward an internal combustion engine with an exhaust gas system, wherein the latter can be configured or modified according to the description above. The invention also relates to a motor vehicle with an internal combustion engine having has such an exhaust gas system. The advantages of such a configuration of the exhaust gas system were mentioned above. The exhaust gas system, the internal combustion engine and/or the motor vehicle can be modified according to the description above so that reference is made to this description.

BRIEF DESCRIPTION OF THE DRAWING

In the following the invention is explained in more detail by way of the exemplary embodiments shown in the drawing without limiting the invention. It is shown in.

DETAILED DESCRIPTION OF PREFERRED EMBODIMENTS

Figure 1:
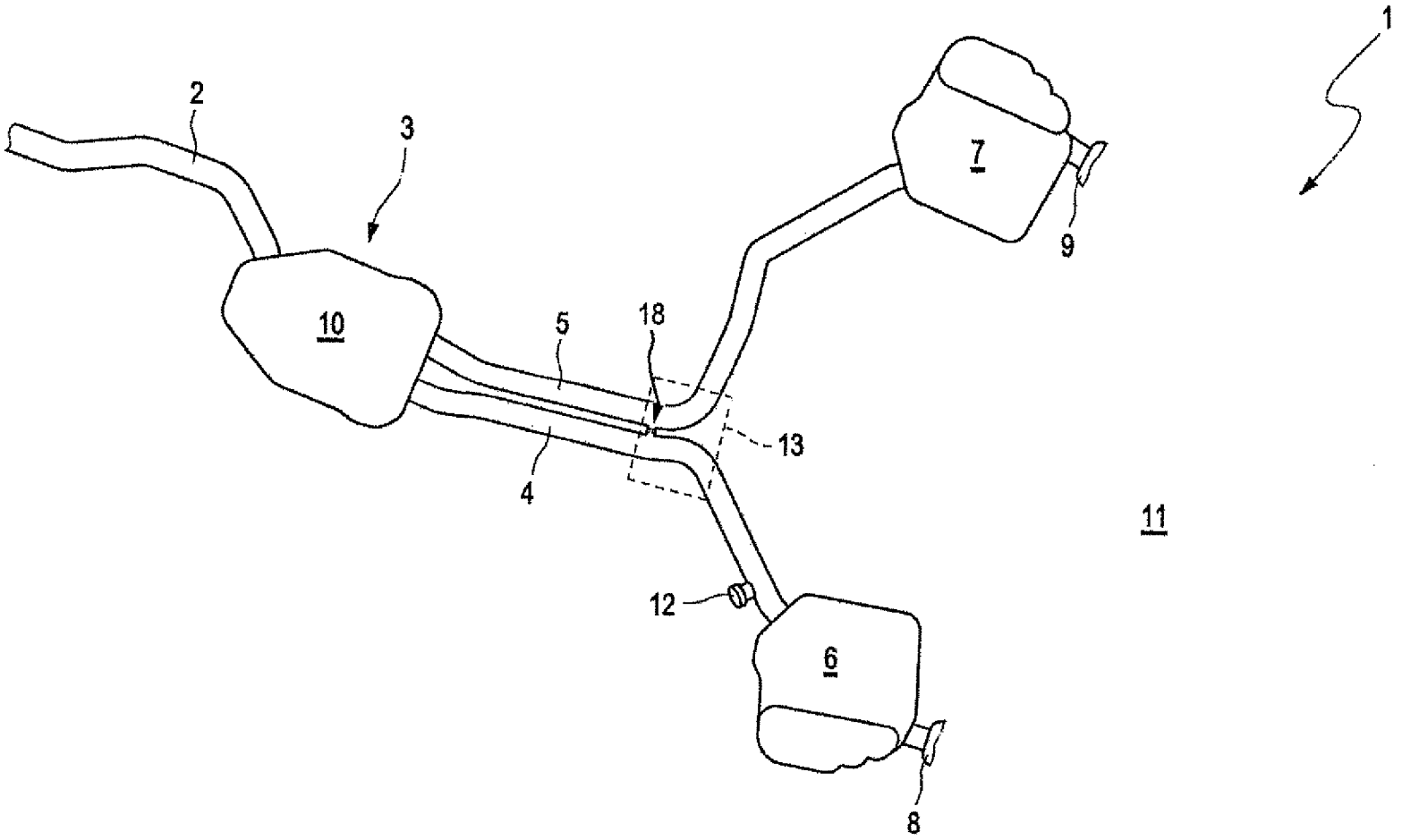
FIG. 1 a schematic representation of a region of an exhaust gas system for an internal combustion engine, and FIG. 2 an embodiment of a damping device for damping exhaust gas resonance vibrations.

FIG. 1 shows a schematic representation of an exhaust gas system 1, which is for example assigned to a here not further shown internal combustion engine. The exhaust gas system 1 has an exhaust gas feed line 2, which transitions at a branch 3 into a first exhaust gas line 4 and a second exhaust gas line 5. The first exhaust gas line 4 leads into a first muffler 6 and the second exhaust gas line into a second muffler 7. The mufflers 6 and 7 are preferably configured as end muffler or after-muffler. Insofar an end tube 8 or 9 is connected to each of the mufflers 6 and 7 on the corresponding side, which faces away from the exhaust gas line 4 or 5.

The exhaust gas generated by the internal combustion engine flows through the exhaust gas feed line 2, which is for example connected to an exhaust manifold of the internal combustion engine, in the direction of the branch 3. There the exhaust gas feed line 2 ends or respectively transitions into the exhaust gas lines 4 and 5. Starting from the branch 3, the exhaust gas can insofar further flow through the exhaust gas lines 4 and 5. At the branch 3 for example a further muffler 10 is arranged, which is in particular configured as a pre-muffler or preferably as a middle muffler. The exhaust gas flowing through the exhaust gas feed line 2 correspondingly flows into the muffler 10 and from the muffler 10 into the first exhaust gas line 4 and the second exhaust gas line 5. Subsequently the exhaust gas can flow through the muffler 6 and 7 into the end tubes 8 and 9 and can be released through end tubes into an external environment 11 of the exhaust gas system 1.

Upstream of the first muffler 6 a control valve 12 is provided in the first exhaust gas line 4, by means of which control valve a flow cross section of the first exhaust gas line 4 can be adjusted. The control valve 12 can correspondingly be used to block the first exhaust gas line completely, to partially release the first exhaust gas line or to completely release it. However because the flow path though the first exhaust gas line 4 from the branch 3 up to the control valve 12 is comparatively long, exhaust gas resonance vibrations may occur in particular as a result of the so-called Helmholtz-resonance. With respect to a mean flow cross section of the first exhaust gas line 4 the distance between the branch 3 and the control valve 12 or the beginning of the first exhaust gas line 4 and the control valve 12 is at least 10, at least 12.5, at least 15, at least 17.5, at least 20, at least 25, at least 30, at least 40 or at least 50.

For avoiding or at least damping the exhaust gas resonance vibrations, a damping device 13 is provided, which is here only indicated schematically. The damping device 13 can have a flow connection between the first exhaust gas line 4 and the second exhaust gas line 5, a sound absorber or a flow rectifier. Of course also any desired combination of these embodiments is conceivable so that for example the damping device 13 has the flow connection and the sound absorber, the damping device and the flow rectifier, the sound absorber and the flow rectifier or the flow connection, the sound absorber and the flow rectifier.

In the embodiment, which has the flow connection between the first exhaust gas line 4 and the second exhaust gas line 5, for example a throttle or a cross section adjustment element 18 is provided, which is arranged in the flow connection. The cross section adjustment element is particularly constructed as a spring-loaded check valve. The sound absorber can be configured as an expansion and/or absorption chamber. As an alternative it can also be configured as a resonance absorber.

Figure 2:
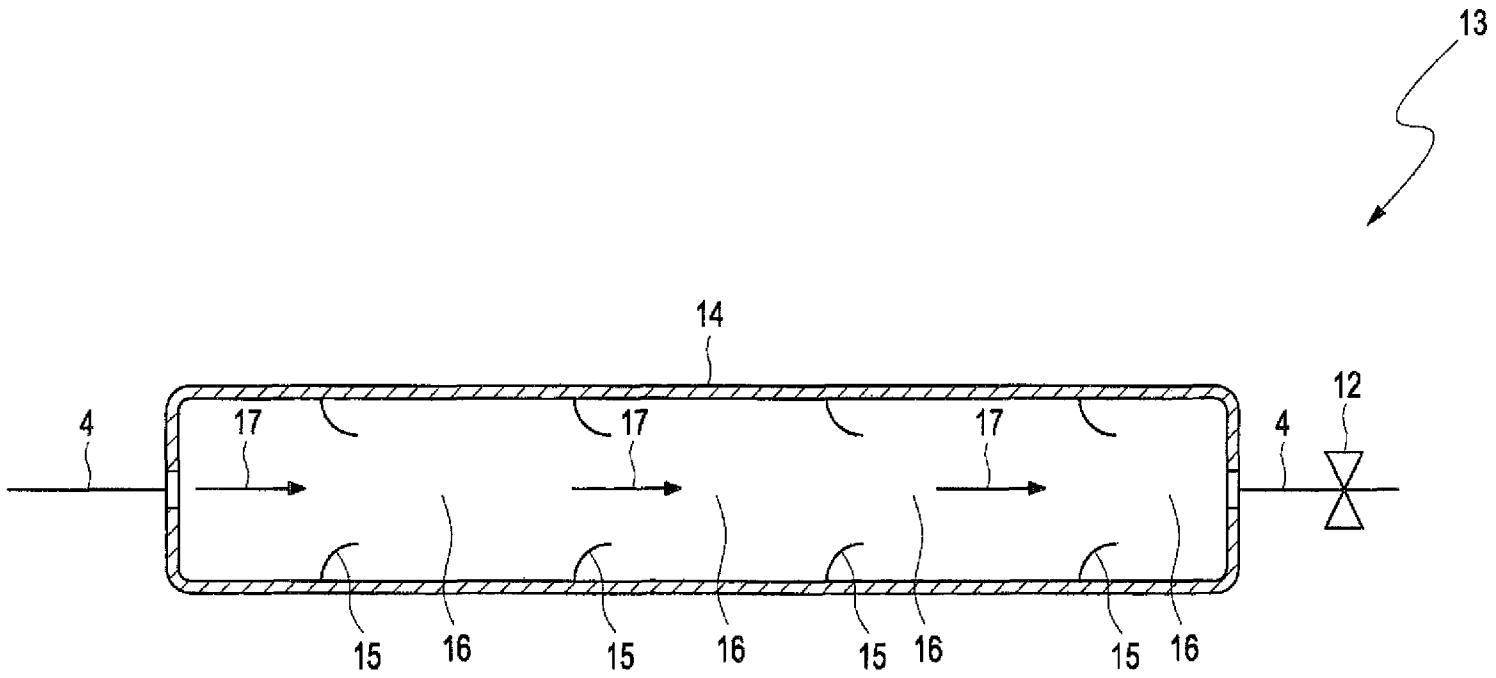

FIG. 2 shows an embodiment of the damping device 13, which in this case is configured as a flow rectifier. Also indicated are the regions of the first exhaust gas line 4 upstream and downstream of the damping device 13 and the control valve 12. The damping device 13 has a housing 14, which initially has a constant inner flow cross section. However, in the housing at least one nozzle 15 is arranged. Preferably multiple nozzles 15, here for example 4 nozzles 15, are present in the housing 14 arranged one after the other in flow direction.

The nozzles 15 cause a reduction of the flow cross section stating from the inner flow cross section of the housing 14 which can also be referred to as housing inner cross section. Preferably the reduction of the flow cross section is hereby continuous. The at least one nozzle 15, however preferably each nozzle 15, leads hi flow direction into an open-jet volume 16 into which the exhaust gas enters downstream of the respective nozzle 15. The exhaust gas flows through the damping device 13 in the direction of the arrows 17. Hereby essentially a reduction of the exhaust gas resonance vibrations, in particular the in the direction perpendicular to the flow direction indicated by the arrows 17, is caused.

The length of the damping device 13 in flow direction is preferably dimensioned so that a predominant portion of the exhaust gas resonance vibrations, in particular almost all exhaust gas resonance vibrations, are sufficiently damped, preferably completely removed. By means of the damping device 13 it is thus possible to arrange the control valve 12 upstream of the first muffler 6. The latter is for example desirable with regard to mounting space because in this way the length of the end tube 8 can be reduced.

The invention claimed is:

1. An exhaust gas system for an internal combustion engine comprising:

a first exhaust gas line leading into a first muffler;

a second exhaust gas line arranged fluidly parallel to the first exhaust gas line and leading into a second muffler, said first and second exhaust gas lines respectively being connected upstream of the first and second muffler at a branch to a common exhaust gas feed line;

a control valve arranged in the first exhaust gas line upstream of the first muffler;

a damping device fluidly arranged between the branch and the control valve and adapted for damping exhaust gas resonance vibrations, said damping device including a housing having an entry end and an exit end for the exhaust gas in a flow direction, and at least one nozzle arranged within the housing in the flow direction of the exhaust gas at a downstream location of the housing in proximity of the exit end; and a cross section adjustment element provided in a flow connection between the first exhaust gas line and the second exhaust gas line.

2. The exhaust gas system of claim 1, wherein the damping device has a sound absorber.

3. The exhaust gas system of claim 2, wherein the sound absorber is constructed as a resonance absorber.

4. The exhaust gas system of claim 1, wherein the cross section adjustment element is constructed as a spring-loaded check valve.

5. The exhaust gas system of claim 1, wherein the at least one nozzle leads into an open-jet volume.

6. The exhaust gas system of claim 1, wherein the second exhaust gas line is configured without a control valve.

7. The exhaust gas system of claim 1, further comprising an exhaust gas turbocharger provided upstream of the branch.

8. The exhaust gas system of claim 1, wherein the nozzle is configured such as to cause a reduction of a flow cross section in the flow direction and to lead into an open-jet volume to thereby effect an increase of the flow cross section in the flow direction.

* * * * *